US005769423A

United States Patent [19]

Walker

[11] Patent Number: 5,769,423

[45] Date of Patent: Jun. 23, 1998

[54] BOARD GAME AND METHOD

[76] Inventor: Robin Walker, 503 Martin Luther King Dr., Greensboro, N.C. 27406

[21] Appl. No.: 900,142

[22] Filed: Jul. 28, 1997

[51] Int. Cl.[6] ..... A63F 3/00

[52] U.S. Cl. ..... 273/287; 273/432

[58] Field of Search ..... 273/282.1, 283, 273/287, 429, 430, 431, 432

[56] References Cited

U.S. PATENT DOCUMENTS

| | | | |
|---|---|---|---|
| 3,670,472 | 6/1972 | Clifford | 35/8 A |
| 4,336,020 | 6/1982 | Zacharin | 434/157 |
| 4,613,309 | 9/1986 | McCloskey | 434/170 |
| 4,961,579 | 10/1990 | Thompson et al. | 273/153 R |
| 5,087,043 | 2/1992 | Billings et al. | 273/157 R |
| 5,112,057 | 5/1992 | Popovic | 273/432 X |
| 5,178,545 | 1/1993 | Thompson | 434/335 |
| 5,386,999 | 2/1995 | Rice | 273/287 |
| 5,454,569 | 10/1995 | Walker | 273/432 X |
| 5,480,157 | 1/1996 | Plummer | 273/432 |
| 5,505,456 | 4/1996 | Schmidt | 273/432 X |

*Primary Examiner*—William E. Stoll

[57] ABSTRACT

A game suited for use in an educational setting includes a game board, a set of cards containing questions and answers, and a set of pictorial supports fitted on the game board containing pictorial hints which help the players determine or remember the answers to the questions posed. A timer tracks the time to answer each question and scores are kept as to how many questions are answered correctly.

15 Claims, 4 Drawing Sheets

BOARD GAME AND METHOD

BACKGROUND OF THE INVENTION

1. Field of the Invention

The invention herein pertains to a board game and particularly to a board game that is easily adapted to educational uses. The game comprises a set of questions and answers asked to each other by the players wherein the number of correct answers forms the basis of keeping score. The players are helped in finding the answers through the use of pictures mounted on reversible pictorial supports.

2. Description of the Prior Art and Objectives of the Invention

Modern day game incarnations range from video games to board games to card games and other numerous permutations. Question and answer type games have a well established niche in the marketplace as demonstrated by the success of "TRIVIAL PURSUIT" and its progeny. These games have even been incorporated into electronic formats and put in an educational setting as seen by U.S. Pat. No. 5,178,545. Other educational tools include puzzle pieces or blocks with pictures as seen in U.S. Pat. No. 4,336,020.

What is not present in the art is a board game that uses pictorial supports to provide hints about the answers to the questions posed during the game. Thus, with the lack of such, it is an object herein to provide a board game that provides questions and answers coupled with pictorial hints to help the players.

It is a further object of the invention to provide a board game having a timer for setting limits on the time allowed to answer a question.

It is another object of the invention to provide a board game that is well suited for use in an educational environment.

It is still a further object of the invention to provide a board game with different sets of questions and hints therefor, designed to be used interchangeably.

It is yet another object of the invention to provide a method for playing this board game which can be easily adapted for use by people of all ages and experience while maintaining high levels of fun and enjoyment.

It is a further object of the invention to provide a game that can be played by visually impaired individuals through the use of braille.

Still further objects and advantages of the invention will become readily apparent to those skilled in the art to which the invention pertains upon reference to the following detailed specification.

SUMMARY OF THE INVENTION

This invention provides a board game and method well suited for an educational setting. The game has several components including a board with reversible, removable blocks or pictorial supports, a die, a timer, a set of cards with questions and answers, and hints in the form of mounted pictures. Ideally, the timer is affixed to the game board with the cards stored conveniently nearby.

BRIEF DESCRIPTION OF THE DRAWINGS

FIG. 3 demonstrates a side view of the game board along line 3—3 of FIG. 1 with dashed lines of the recesses there in;

DETAILED DESCRIPTION OF THE PREFERRED EMBODIMENT AND OPERATION OF THE INVENTION

Figure 1:
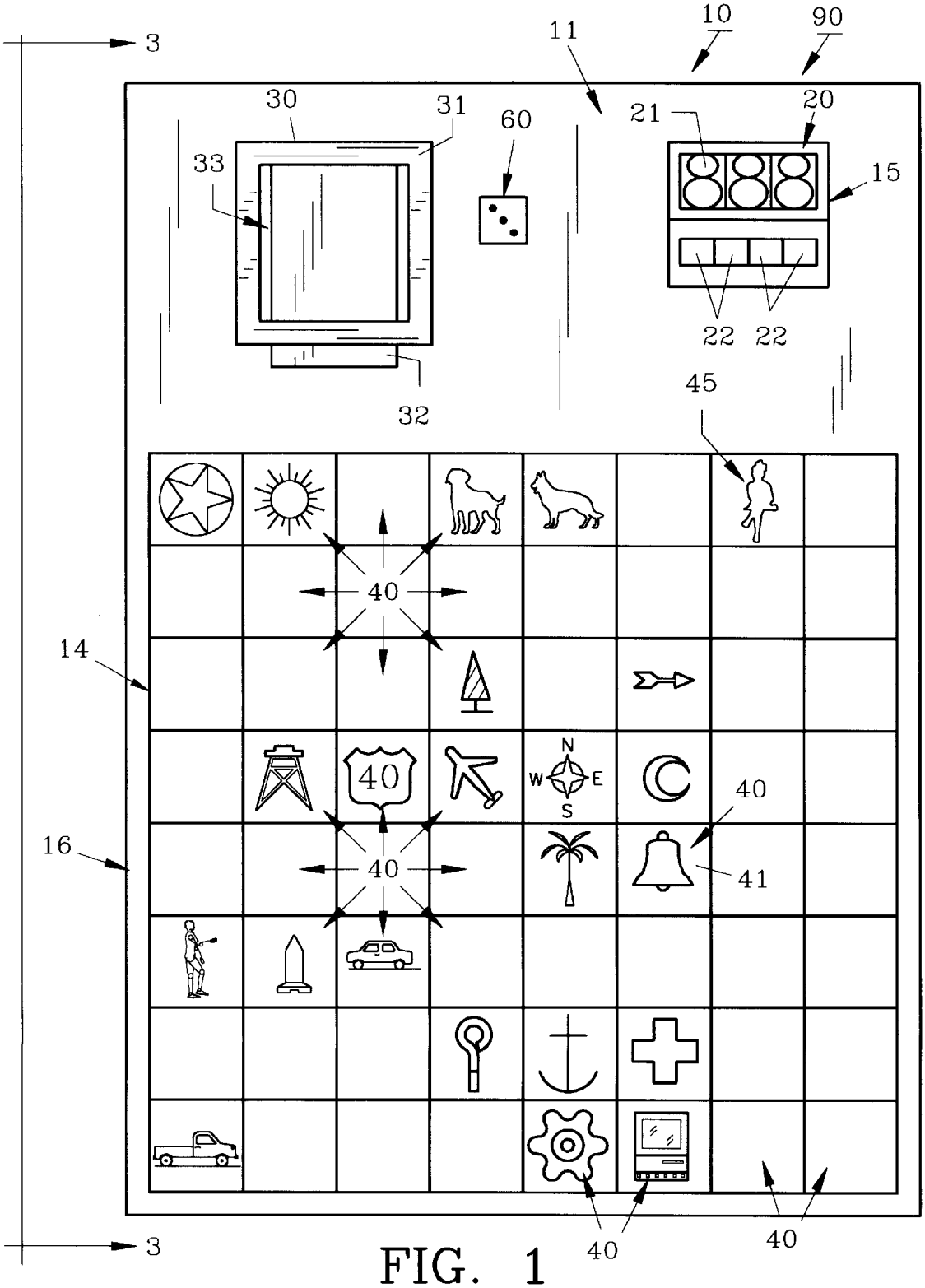
FIG. 1 shows a top view of the preferred game board with the major components resting thereon.

Turning now to the drawings, FIG. 1 shows game 90 including the preferred embodiment game board 10 made of wood or plastic, although plastic is preferred, the preferred embodiment having top 11, bottom 13 (FIG. 3), first recess 14 with edge 16 therearound and second recess 15. Conventional electronic timer 20 with display 21 and controls 22 rests in second recess 15 adapted to fit timer 20. While conventional electronic timer 20 is shown in the preferred embodiment, it is within the scope of the present invention to replace electronic timer 20 with an hourglass, a mechanical clock or similar device (none shown). In such a case, second recess 15 could be resized to fit the selected alternate timer.

Figure 2B:
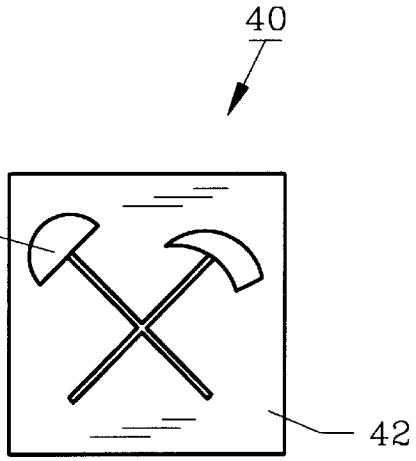
FIG. 2B illustrates a closeup of the bottom of the pictorial support as seen in FIG. 2A.
Figure 2A:
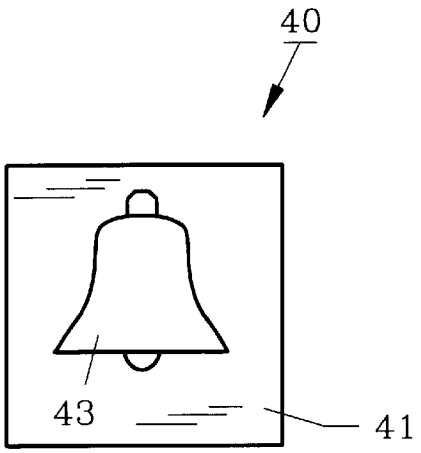
FIG. 2A depicts a closeup view of the top of one of the pictorial supports removed from the game board.
Figure 5A:
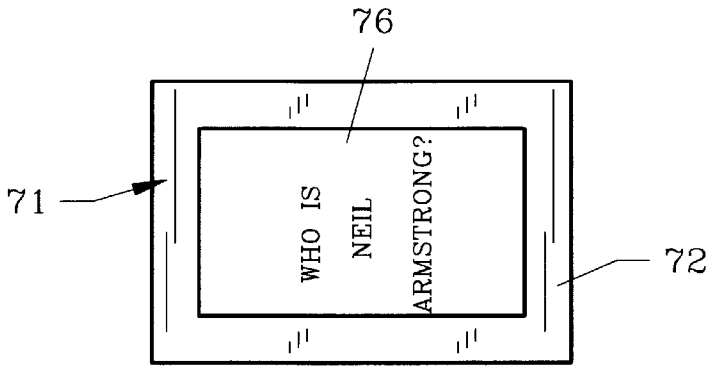
FIGS. 5A and 5B present a typical card front and back respectively with a sample question and answer printed thereon.
Figure 5B:
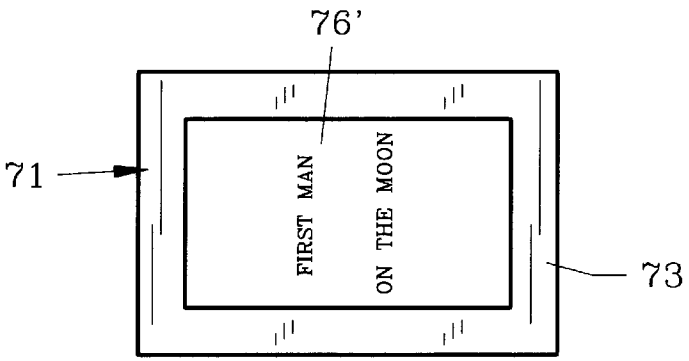

Located in large first recess 14 of FIG. 1 are a plurality of pictorial supports 40 with generic pictures such as picture 45 thereon. In the preferred embodiment, each pictorial support 40 is identically, rectangularly sized and shaped to make up an eight by eight (8×8) grid for a total of sixty-four (64) pictorial supports 40 (some seen blank in FIG. 1 for brevity). Each pictorial support 40 has top 41 and bottom 42 with first picture 43 and second picture 44 positioned thereon respectively (FIGS. 2A and 2B). Each pictorial support 40 has different pictures on top 41 and bottom 42 for a total of one hundred twenty-eight (128) different pictures. Each picture comprises a pictorial hint for one of the questions on cards 71 in card stack 70. Therefore, in the preferred embodiment, there are one hundred twenty-eight (128) cards 71 which act as means for containing question text 76 and answer text 76' in card stack 70 to match the one hundred twenty-eight (128) pictures located on top 41 and bottom 42 of the sixty-four (64) pictorial supports 40 (FIGS. 5A and 5B).

Resting on game board 10 in FIG. 1 is conventional six sided die 60 and card holder 30. Card holder 30 is substantially planar and top 31 defines rectangular window 33. Card holder 30 is sized so that when typical card 71 (FIGS. 5A and 5B) is placed on base 32 of card holder 30, text 76 or 76' as explained below of card 71 can be easily read through window 33. It is to be understood, that in the preferred embodiment of the present invention, each card 71 has its own individual card holder 30 prepackaged around card 71 allowing card 71 to be drawn from card stack 70 without the answer being visible. It shold also be understood, that card holder 30 allows card 71 to be removed and turned over to view the answer thereon.

Figure 3:
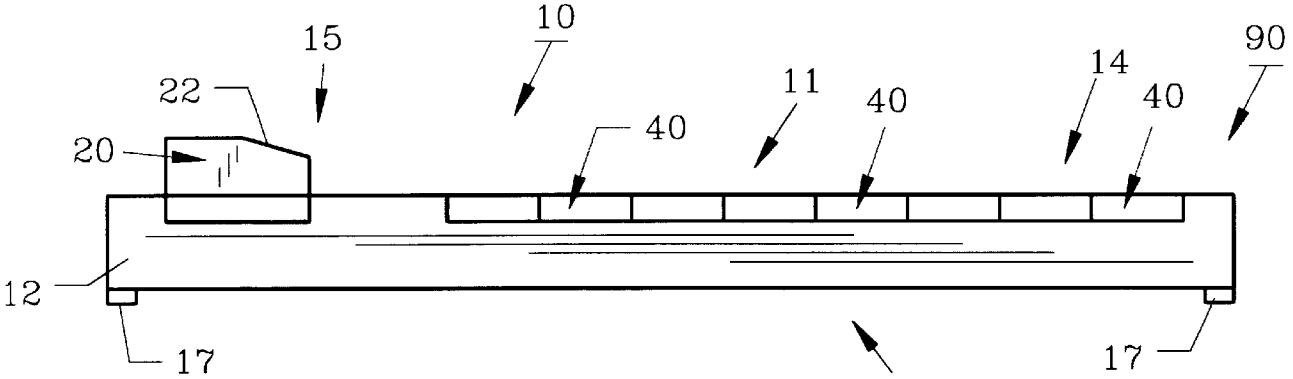

FIG. 3 shows a side view of game board 10 along line 3—3 of FIG. 1 with card holder 30 and die 60 removed. Side 12 connects top 11 and bottom 13 with first recess 14 therebetween. First recess 14 has sufficient depth so that pictorial supports 40 are flush with top 11 of game board 10, and second recess 15 sized such that timer 20 extends above top 11 for easy access. Bottom 13 has rubber feet 17 placed thereon at the corners to prevent game board 10 from sliding when placed on a surface such as a table top (not shown).

Figure 4:
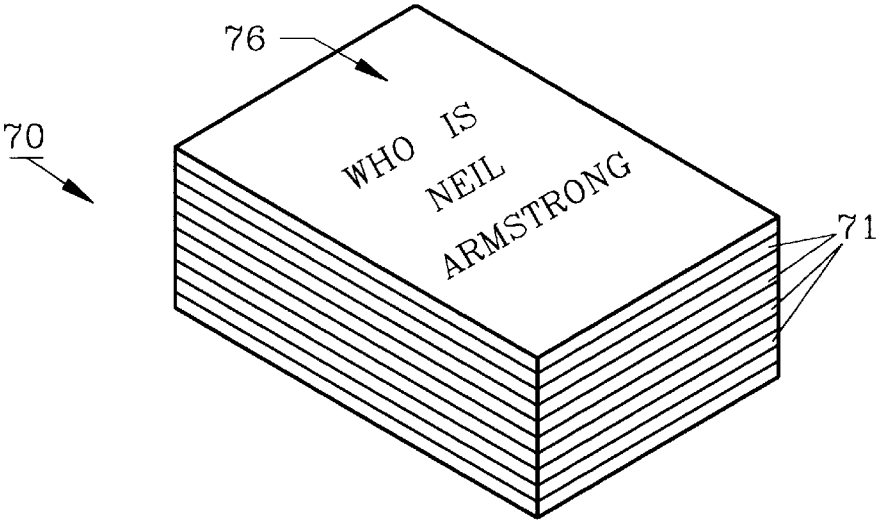
FIG. 4 pictures a card stack with questions printed thereon.

Card stack 70 as seen in FIG. 4 includes cards 71 having text 76 which provides questions on front 72 and text 76' which provides an answer on back 73. (See FIGS. 5A and 5B). Questions and answers are different for each card 71 as would be understood. As detailed above, in the preferred embodiment, card stack 70 would actually be a stack of cards 71 and card holders 30.

Game 90 can be adapted to numerous games for players of different educational and skill levels by providing different sets of pictorial supports 40 and card stacks 70, thereby changing question topics from, for example, geography to history or changing the level from world history to United States history. It should also be noted that it is within the scope of the present invention that card stack 70 can be replaced, for example with a computer program and computer, (not shown) that flashes questions, keeps track of time and verifies answers to questions asked, or similar mechanism and method for conveying a question to a player. Likewise an electronic implementation of game board 10 is possible with LEDs and mechanisms (not shown) for changing pictures on pictorial supports 40.

Figure 6:
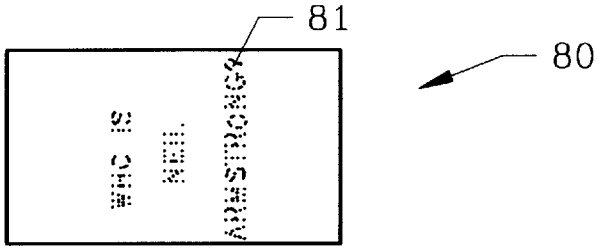
FIG. 6 features a card with the text in braille.
Figure 7:
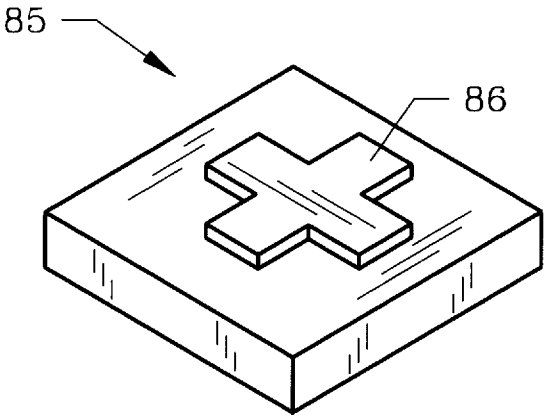
FIG. 7 shows a pictorial support with the image thereon raised for a visually impaired player.

It is also within the scope of the present invention to provide a game that can be played by visually impaired individuals. Specifically, as seen in FIG. 6, braille card 80 has braille text 81 in the form of a question and answer thereon. Likewise, in FIG. 7, braille support 85 has raised image 86 thereon to convey the same hint that a normal picture 45 would to a non visually impaired individual.

In the preferred method of playing game 90, each player (not seen) rolls die 60 with ties of die scores being re-rolled to break the tie. Players arrange themselves around game board 10 with the player who rolled the, highest number sitting first and then, in counter clockwise fashion, each player sitting in descending order of the number rolled.

Play commences with the player who rolled the highest on the die drawing a card 71 and card holder 30 from card stack 70. The other players choose how much time this first player has to answer the question, not to exceed 30 seconds, and set timer 20 to that selected time. The first player now reads question text 76 of drawn card 71 and another player starts timer 20. The first player may sort through pictorial supports 40 in recess 14 of game board 10 and look for the picture such as picture 45 that provides the hint for the question he has been asked. The first player has three chances to answer the question. If the first player answers the question correctly, he keeps the card and play passes in a counter clockwise direction to the next player who repeats first player's actions by drawing a card 71 in card holder 30, letting the other players choose how much time he has to answer the question thereon, reading the question and letting another player start timer 20. Play continues around game board 10 until all questions are answered or until a particular score is accumulated for answering questions by a particular player.

If a player cannot correctly answer a question in the allotted time or in the three chances allowed, that player is given the opportunity to find the correct answer, which usually entails looking at the answer on the back of the card, but play continues around game board 10 until play returns to the player who could not answer the question correctly. That player is given another opportunity to answer the question that they originally could not answer, but he or she does not get to draw another card. The player with the most correctly answered questions, i.e. the player with the most cards 71 at the end of the game, is the winner.

The preceding recitation is provided as an example of the preferred embodiment and is not meant to limit the nature or scope of the present invention. As would be expected, mere changes in the shape or implementation of the game board are clearly contemplated.

What is claimed is:

1. A game comprising:

a) a game board, said board defining a first recess;

b) means for timing play, said timing means contiguous to said game board;

c) means for containing text, said text containing means positioned proximate said game board; and d) a plurality of pictorial supports, said pictorial supports disposed within said first recess.

2. The game as claimed in claim 1 wherein said game board further defines a second recess, said timing means mounted in said second recess.

3. The game as claimed in claim 1 wherein said text containing means comprises a plurality of cards, each of said cards having text thereon.

4. The game as claimed in claim 1 further comprising a plurality of pictures, said pictures mounted on said pictorial supports.

5. The game as claimed in claim 4 wherein said pictorial supports are two-sided, with said pictures mounted on each side.

6. A game comprising in combination:

a) a game board, said game board defining a first recess and a second recess;

b) a plurality of pictorial supports, said pictorial supports mounted in said first recess;

c) a timer, said timer mounted in said second recess;

d) a plurality of cards, said plurality of cards proximate said game board;

e) a plurality of card holding devices, said card holding devices proximate said game board;

f) a die, said die proximate said game board;

g) text, said text placed on said plurality of cards; and h) a plurality of pictures, said pictures mounted on said pictorial supports.

7. The game as claimed in claim 6 wherein said die has six sides.

8. The game as claimed in claim 6 wherein said card holding device comprises: a base and a top, said top affixed to said base and said top defining a window.

9. The game as claimed in claim 6 wherein each of said plurality of cards has two sides and wherein said text is placed on both sides.

10. The game as claimed in claim 6 wherein said game board is plastic.

11. A method of playing a board game by a plurality of players utilizing a game board, a timer, a plurality of question cards, and a plurality of two-sided pictorial supports mounted on the game board, said pictorial supports having different pictures on each side of each pictorial support, the method comprising the steps of:

a) selecting a card;

b) reading the question thereon;

c) scanning the pictorial supports; and d) answering the question.

12. The method as claimed in claim 11 further comprising the step of manipulating the pictorial supports to view the pictures on each side.

13. The method as claimed in claim 11 and further comprising limiting the time to answer the question.

14. The method as claimed in claim 11 wherein the step of selecting a card comprises drawing the top card from the card stack.

15. The method as claimed in claim 11 and further comprising the step of keeping score.

* * * * *